US007779510B2

(12) United States Patent
Hoffman

(10) Patent No.: US 7,779,510 B2
(45) Date of Patent: Aug. 24, 2010

(54) MULTI-AXIS DOOR HINGE

(75) Inventor: Lawrence Andrew Hoffman, Portland, OR (US)

(73) Assignee: The Hoffman Group International, Ltd. (VG)

( * ) Notice: Subject to any disclaimer, the term of this patent is extended or adjusted under 35 U.S.C. 154(b) by 25 days.

(21) Appl. No.: 11/867,666

(22) Filed: Oct. 4, 2007

(65) Prior Publication Data

US 2008/0083089 A1 Apr. 10, 2008

Related U.S. Application Data

(60) Provisional application No. 60/828,217, filed on Oct. 4, 2006.

(51) Int. Cl.
*E05D 3/10* (2006.01)

(52) U.S. Cl. ..... 16/367; 296/146.12

(58) Field of Classification Search ..... 16/367, 16/366, 389, 302, 287, 248, 374, 282, 294, 16/239; 49/257, 254; 296/146.11, 146.12, 296/146.9

See application file for complete search history.

(56) References Cited

U.S. PATENT DOCUMENTS

| | | | | |
|---|---|---|---|---|
| 6,808,223 | B1 * | 10/2004 | Baum et al. | 296/146.12 |
| 6,820,918 | B1 * | 11/2004 | DeBono | 296/146.11 |
| 6,845,547 | B2 * | 1/2005 | Ham | 16/374 |
| 7,007,346 | B2 * | 3/2006 | Hoffman | 16/367 |
| 7,048,322 | B2 * | 5/2006 | DeBono | 296/146.11 |
| 7,059,655 | B2 * | 6/2006 | Ham | 296/146.12 |
| 7,100,245 | B2 * | 9/2006 | Wohlfarth | 16/367 |
| 7,140,075 | B2 * | 11/2006 | Ham | 16/374 |
| 7,210,200 | B2 * | 5/2007 | Hoffman | 16/367 |
| 2007/0214606 | A1 * | 9/2007 | Hoffman | 16/367 |
| 2008/0083090 | A1 * | 4/2008 | Hoffman | 16/367 |

* cited by examiner

*Primary Examiner*—William L. Miller
(74) *Attorney, Agent, or Firm*—Silicon Forest Patent Group; Paul J Fordenbacher, Esq.

(57) ABSTRACT

Embodiments of multi-axis vehicle door hinges are provided that are adapted to facilitate pivotal motion of a vehicle door about a substantially vertical axis of rotation for swing-out rotation as well as to facilitate pivotal motion of a vehicle door about a substantially horizontal axis of rotation for vertical-lift rotation and providing means for adjusting the opening angle of the hinge in both the horizontal and vertical axis of rotation.

13 Claims, 7 Drawing Sheets

MULTI-AXIS DOOR HINGE

RELATED APPLICATIONS

This application is a U.S. non-provisional Patent Application taking priority to U.S. provisional Patent Application 60/828,217, filed Oct. 4, 2006, incorporated herein in its entirety by reference, and is related to U.S. non-provisional patent application Ser. No. 11/691,491, filed Mar. 26, 2007, incorporated herein in its entirety by reference, and related to U.S. non-provisional patent application Ser. No. 11/056,136, now U.S. Pat. No. 7,210,200, filed Feb. 11, 2005, incorporated herein in its entirety by reference, and U.S. non-provisional patent application Ser. No. 10/396,284, now U.S. Pat. No. 7,007,346, filed Mar. 25, 2003, incorporated herein in its entirety by reference.

FIELD

Embodiments presented relate to vehicle door hinges, and more particularly, to multi-axis door hinge components and swing-out vertical-lift door assemblies with independent function characteristics.

BACKGROUND

One aspect of the vehicle that has changed little is the swing-out door. The swing-out door is suspended from the vehicle body using conventional single-axis hinges. Each single-axis hinge comprises two leaves; a stationary leaf that is usually mounted on a forward portion of a doorjamb, and a hinge leaf that is usually mounted on a forward portion of a door edge. Each leaf comprises one or more knuckles which have coaxial through bores. The knuckles of two leaves are interleaved such that the through bores are placed in coaxial alignment. The leaves are rotatably joined together with a hinge pin extending through the bores.

The conventional single-axis hinge permits rotation within one plane. As the door is opened, the rear door edge swings out from the side of the vehicle in a substantially horizontal plane, whereby a space for stepping-in and stepping-out is formed between the rear door edge and the vehicle body. A major issue with swing-out doors is the situation of tight parking spaces with little room for the door to swing open to allow ingress and egress. Also, the potential for damage to an adjacent vehicle is a persistent problem resulting in the inevitable door ding.

Other door opening configurations have been tried, such as sliding, gull wing, and vertical-lift doors. Sliding doors are popular on vans, but not vehicles. The single-axis hinges of the gull wing door are mounted along the upper door edge, the door forming a portion of the roof, and permits rotation of the door above the vehicle; a design made famous by DeLorian Motor Company. The single-axis hinge of the vertical-lift door, which is also known as lambo, scissors, or jack-knife doors, is mounted in the forward upper door corner which permits door rotation substantially within a vertical plane defined by the door; a design made famous by Lamborghini.

The advantages of the vertical-lift door are both functional and aesthetic. Since the rotation of the door is upward and not sideways, as with the common swing-out door, ingress and egress is greatly facilitated in closely-spaced parking situations. The vertical-lift door eliminates the potential of banging the door against an object located to the side of the vehicle. The vertical-lift door also adds a sense of style and luxury to the vehicle.

For the most part, vertical-lift doors have been available only on expensive luxury performance vehicles and vehicles assembled from a kit by the consumer. These vehicles have door and door jam configurations, single-axis hinges, and latching mechanisms specifically designed into the vehicle to permit the door to open vertically.

Many vehicle enthusiasts consider it highly desirable to incorporate exotic features into their ordinary stock vehicles. The vertical-lift door is one such feature that has, for the most part, been out of reach of the aftermarket enthusiast. Retrofitting the conventional door to operate as a vertical-lift door is difficult to impossible due in part to door and vehicle body style. Many vehicle body styles incorporate doors with contoured surfaces that would collide with the vehicle body if opened as a vertical-lift door.

In some vehicle body styles, the bottom edge of the door undercuts the vehicle body and, therefore, would prevent vertical rotation of the door. Other vehicle body styles incorporate roof structures that overhang the top edge of the door, precluding vertical rotation of the door.

These and other issues hinder the availability of aftermarket components that would permit the vehicle enthusiast to retrofit the conventional swing-out door to operate as a vertical-lift door. These issues also hinder the vehicle manufacturers from incorporating vertical-lift doors in vehicles without requiring major redesign of the current vehicle body styles which may or may not be aesthetically pleasing to the customer.

It would, therefore, be highly desirable to have components and assemblies that would provide vehicle manufacturers and aftermarket enthusiasts the ability to incorporate the motion of the vertical-lift door in currently designed vehicles without major modification to the vehicle body or door structures.

DETAILED DESCRIPTION

In the following detailed description, reference is made to the accompanying drawings which form a part hereof wherein like numerals designate like parts throughout, and in which is shown by way of illustration specific embodiments in which they may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

In the following detailed description, various terms are used to define various elements of a hinge. Other terms are used in the art to reference the same hinge element. Therefore, it is understood that the present invention is not to be limited by the use of a particular term used in reference to a particular hinge element. The following terminology is used throughout the description: a conventional hinge comprises two leaves, namely a stationary leaf and a hinge leaf, which pivot on a single axis of rotation; a leaf consists generally of a mounting portion, such as, but not limited to, a mounting plate, and one or more knuckles; a knuckle comprises an element, generally circular, having a bore adapted to accept a hinge pin, the knuckle extending from a mounting portion of a leaf; a notch is a space between two adjacent knuckles on one leaf into which a knuckle from a second leaf is positioned and interleaved; a stationary leaf is the leaf which is attached to a non-moving structure, such as a door frame; a hinge leaf is a leaf which is attached to a door; and a hinge pin is generally a rod adapted to pass through the bore of the interleaved knuckles of two leaves to join the leaves together.

Embodiments of multi-axis vehicle door hinges are provided that are adapted to facilitate pivotal motion of a vehicle door about a substantially vertical axis of rotation for swing-out rotation, as well as to facilitate pivotal motion of a vehicle door about a substantially horizontal axis of rotation for vertical-lift rotation. Other embodiments of multi-axis vehicle door hinges are provided with means for adjusting the opening angle of the hinge in both the horizontal and vertical axis of rotation.

Figure 1A:
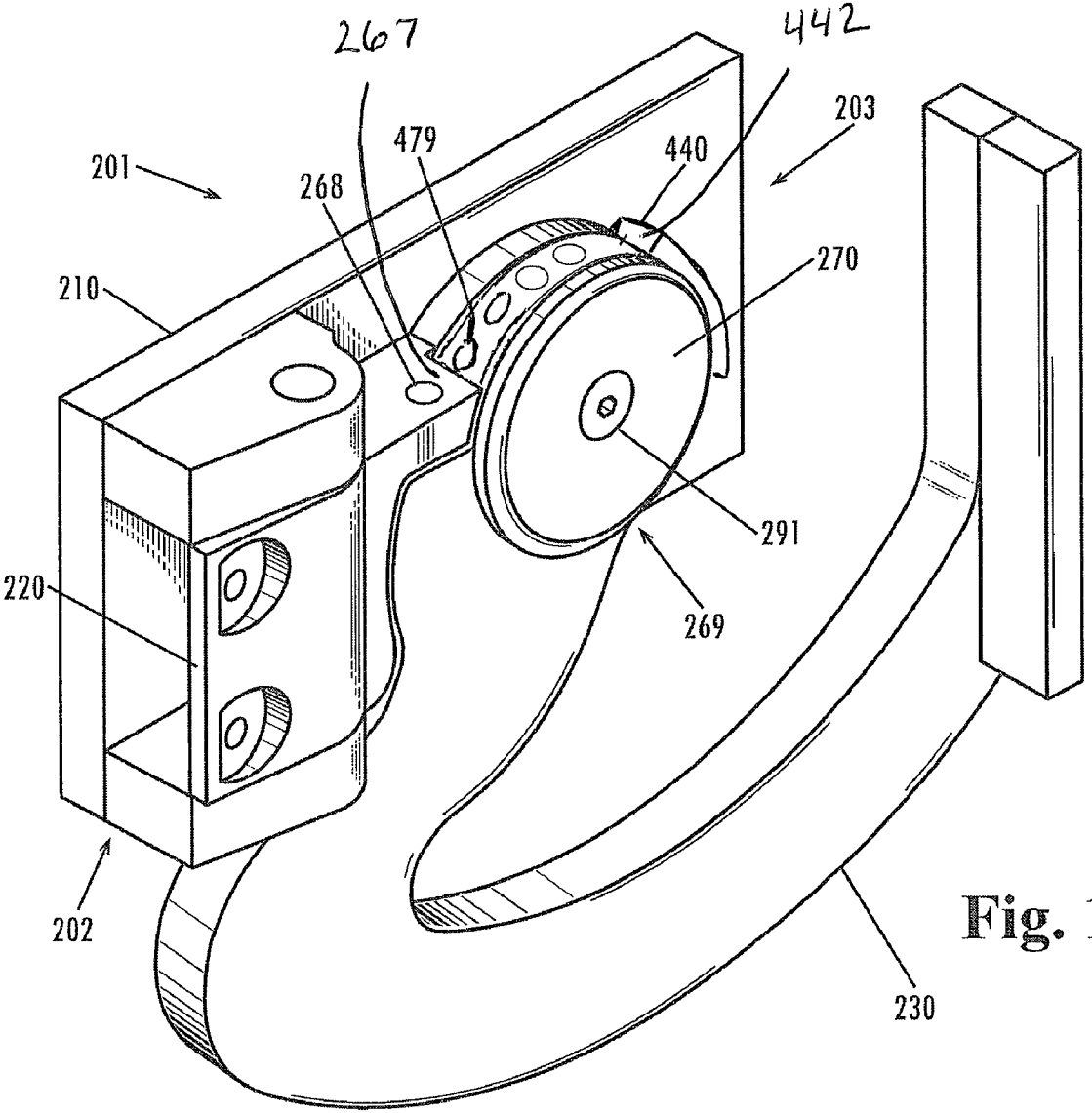
FIGS. 1A-1C are perspective views of a multi-axis vehicle door hinge in a closed and open position, and exploded view, respectively, in accordance with an embodiment.
Figure 1B:
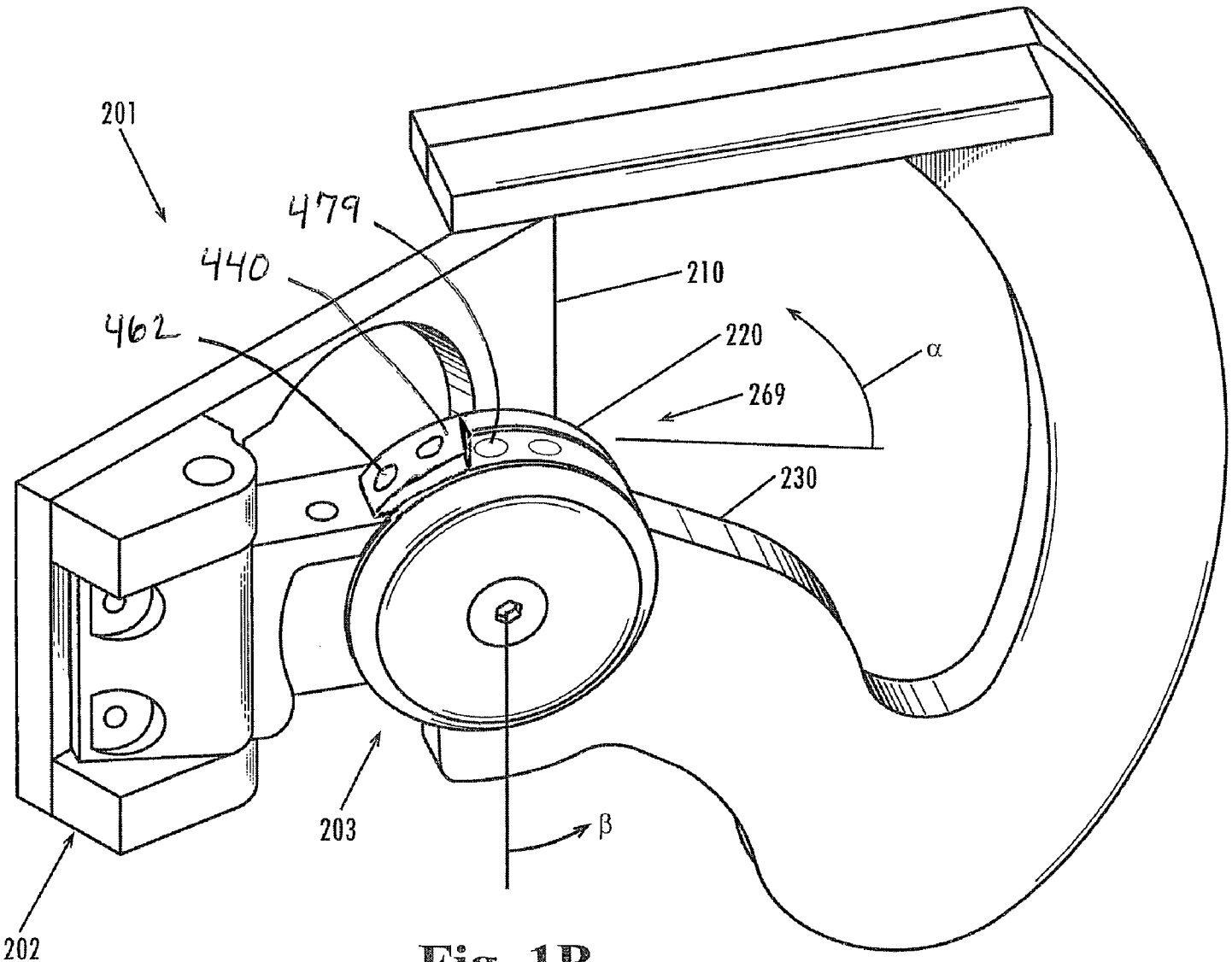
Figure 1C:
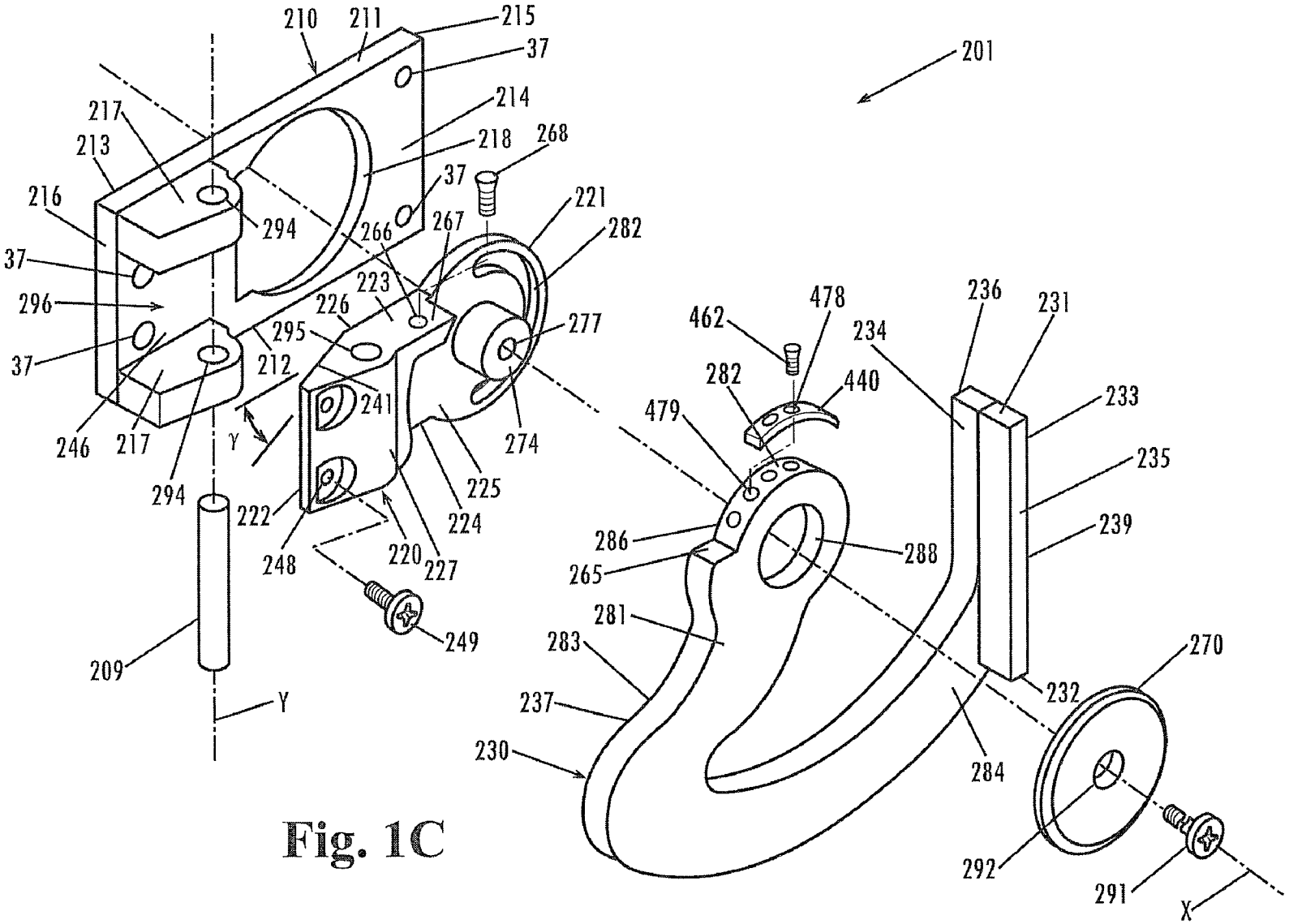

FIGS. 1A-1C are perspective views of a multi-axis vehicle door hinge 201 in a closed and open position, and exploded view, respectively, in accordance with an embodiment. The multi-axis vehicle door hinge 201 comprises a first leaf 210, a second leaf 220, and a third leaf 230. The first leaf 210 and the second leaf 220 are coupled with a hinge pin 209 defining a swing-out hinge 202 that provides rotation in a substantially horizontal plane about a substantially vertical axis of rotation Y. The second leaf 220 and the third leaf 230 are coupled about a lift bearing 269 defining a vertical-lift hinge 203 that provides rotation in a substantially vertical plane about a substantially horizontal axis X of rotation. The multi-axis vehicle door hinge 201, therefore, provides rotation in a substantially horizontal plane, noted as swing angle .alpha., and rotation in a substantially vertical plane, noted as lift angle .beta., separately, and in combination, to suit a particular purpose.

Figure 2:
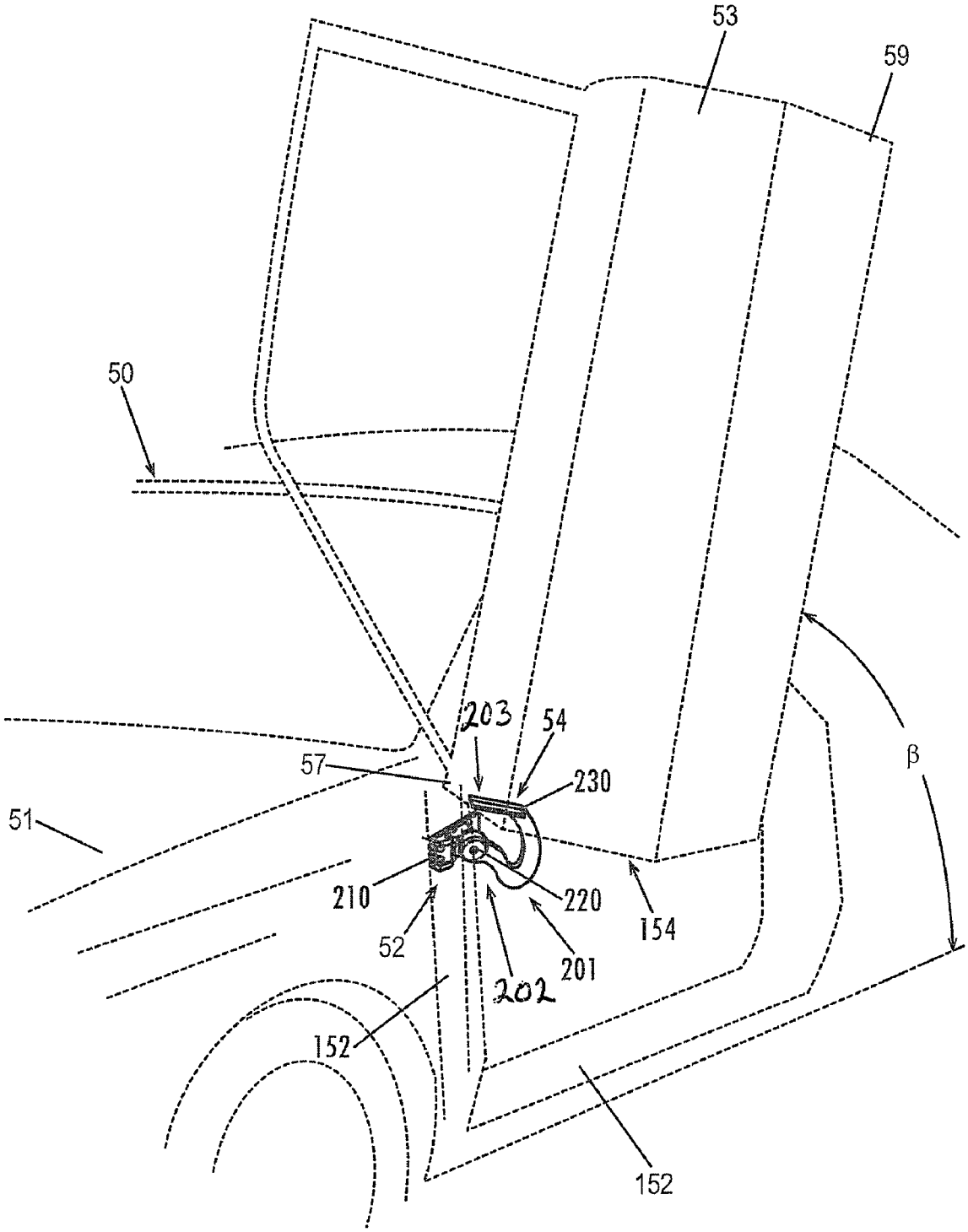
FIG. 2 is a front perspective view of an application of the multi-axis vehicle door hinge as used to provide a door of a vehicle with vertical-lift operation, in accordance with an embodiment.

FIG. 2 is a front perspective view, of an application of the multi-axis vehicle door hinge 201 as used to provide a door of a vehicle with vertical-lift operation, in accordance with an embodiment. The multi-axis vehicle door hinge 201 is adapted to provide a door 53 of a vehicle 50 with swing-out and vertical-lift operational characteristics, in accordance with an embodiment.

The first leaf 210 is adapted to be coupled to a hinge mount body surface 52 of a doorjamb 152 as shown in FIG. 2. The first leaf 210, therefore, is adapted to function as a stationary leaf. The third leaf 230 is adapted to be coupled to a hinge mount door surface 54 of a door edge 154, to function as a hinge leaf. The second leaf 220 is pivotally coupled about a vertical axis of rotation to the first leaf 210, and pivotally coupled about a horizontal axis of rotation to the third leaf 230 which provides rotation of the door 53 within a substantially horizontal and substantially vertical plane, respectively.

The multi-axis vehicle door hinge 201, as will be discussed below, provides a combination of swing-out and vertical-lift motion for, among other things, the retrofitting of a conventional single-axis swing-out vehicle door for swing-out and vertical-lift operation. In an embodiment, the door 53 is adapted to open from a closed position in the conventional swing-out rotation about the swing-out hinge 202 within a substantially horizontal plane. At a predetermined angle . alpha. of the door 53 to the vehicle body 51, the door 53 is adapted to rotate upward about the vertical-lift hinge 203 within a substantially vertical plane to a predetermined lift angle .beta. The door 53 is adapted to close by lowering the door 53 to the substantially horizontal orientation and swung-in in the conventional manner.

Referring again to FIGS. 1A-1C, each leaf is discussed in turn below. The first leaf 210 comprises a first leaf first edge 211, a first leaf second edge 212, a first leaf first side 213, a first leaf second side 214, a first leaf third edge 215, and a first leaf fourth edge 216. Extending from the first leaf second side 214 adjacent the first leaf fourth edge 216 are two spaced apart first swing knuckles 217 defining a swing notch 296 there-between. The first swing knuckles 217 each define a first swing knuckle bore 294 therethrough. The axis of the first swing knuckle bores 294 are in substantially coaxial alignment and extend substantially along the vertical axis Y when the first leaf 210 is coupled to a vehicle 50 for a particular purpose. The swing notch 296 is adapted to accept a second swing knuckle 227 of the second leaf 220, as will be discussed below.

The first leaf 210 further comprises a recessed portion 218, extending a predetermined distance into the first leaf second side 214. The recessed portion 218 is adapted to receive a portion of the second leaf 220, as will be described below. In another embodiment, the recessed portion 218 is a through hole extending from the first leaf second side 214 to the first leaf first side 213. In yet another embodiment, the first leaf 210 has no recessed portion as defined above.

Referring again to FIGS. 1A-1C, the second leaf 220 comprises a second leaf first end 221, a second leaf second end 222, a second leaf first edge 223, a second leaf second edge 224, a second leaf first side 225, and a second leaf second side 226. The second leaf second end 222 comprises a second swing knuckle bore 295 extending between the second leaf first edge 223 and the second leaf second edge 224 defining a second swing knuckle 227. The second swing knuckle 227 of the second leaf 220 is adapted to be interleaved within the swing notch 296 of the first leaf 210 with the axis of the first swing knuckle bores 294 and second swing knuckle bore 295 in substantially coaxial alignment, as discussed below.

A lift hub 274 defining a cylindrical shape extends substantially perpendicular from the second leaf first side 225 adjacent the second leaf first end 221 and defining a horizontal axis X substantially transverse to the second swing knuckle bore 295, which is located along the vertical axis Y. The lift hub 274 defines a first half of a lift bearing 269. The lift hub 274 further comprises a threaded bore 277 to receive a fastener 291 therein, as explained further below.

The second leaf second end 222 comprises a bevel portion 241 defined therein. The bevel portion 241 faces the first leaf 210 and prevents rotation of the second leaf 220 greater than a predefined bevel angle .gamma., such as, but not limited to, 20.degree. (degrees), by the impact of the bevel portion 241 with a bevel impact surface 246 on the first leaf second side 214 adjacent the first leaf fourth edge 216. The second leaf second end 222 defines one or more threaded swing-limiting bores 248 extending through to the bevel portion 241. End portions of suitable fasteners 249, such as but not limited to bolts and set screws, adjustably extend beyond the bevel portion 241 to contact the bevel impact surface 246 when the second leaf 220 is at a predetermined swing angle .alpha. to provide adjustability of the extent of the swing angle .alpha. up to the maximum bevel angle .gamma.

In the embodiment of FIG. 1C, the second leaf first end 221 is adapted to be at least partially contained within the recessed portion 218 of the first leaf 210. The second leaf first end 221 defines a semi-circular shape having an axis substantially coaxial with the lift hub 274. Other nesting shapes of the second leaf first end 221 and the recessed portion 218 are anticipated suitable for a particular purpose. The second leaf first end 221 being adapted to be at least partially contained within the recessed portion 218 of the first leaf 210 provides for an extended swing extension when in the closed position providing a hinge that can swing more closed than if not present. In another embodiment, there is no recessed portion, thereby providing a reduced swing angle in the closed position suitable for a particular purpose.

FIG. 1C shows a perspective view of the third leaf 230, in accordance with an embodiment. The third leaf 230 comprises a third leaf first end 231, a third leaf second end 232, a third leaf first side 233, a third leaf second side 234, a third leaf first edge 235, and a third leaf second edge 236 defining a mount plate 239. The third leaf 230 further comprises a lift arm 237, which extends from the third leaf second side 234. The lift arm 237 has a generally goose-neck shape having an arm first end 284 coupled with the third leaf second side 234 and terminating at an arm second end 286. The lift arm 237 comprises an arm first side 281 and an arm second side 283. The arm second end 286 comprises an arm bore 288 extending from the arm first side 281 to the arm second side 283 and having an axis extending substantially perpendicular to the arm first side 281 and the arm second side 283.

The arm bore 288 is adapted to receive the lift hub 274 therein in substantially coaxial alignment therewith. The arm bore 288 defines a second half of the lift bearing 269, shown in FIG. 1A.

The particular shape of the lift arm 237 is chosen suitable for a particular purpose. The goose-neck shape, as shown in FIG. 1C, is suitable to provide, such as, but not limited to, an extension of an attached door 53 so as to clear structures of the vehicle 50 when the multi-axis vehicle door hinge 201 is operated. Other shapes of the lift arm 237 are anticipated suitable for a particular purpose.

Referring also to FIG. 2, the mount plate 239 of the third leaf 230 is adapted to be coupled to the hinge mount door surface 54 of the door edge 154 using any number of appropriate coupling means known in the art, including, but not limited to, welding, brazing, and mechanical fastening, as will be discussed further below.

Figure 3:
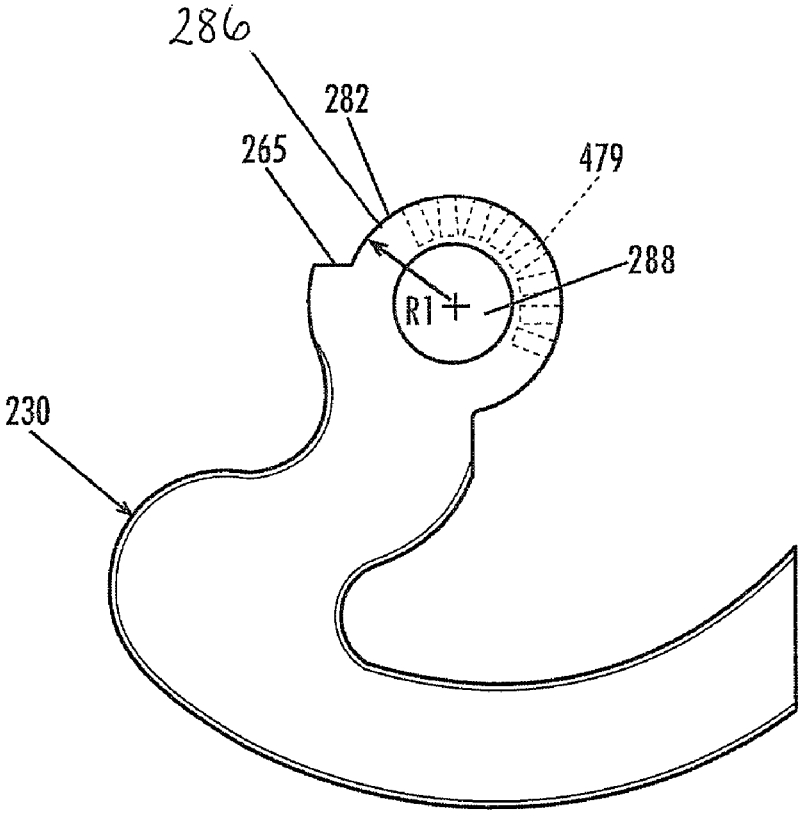
FIG. 3 is a side view of a lift arm of the multi-axis vehicle door hinge showing the lift arm comprising edge fastener bores for coupling with a lift rotation limiter in accordance with the embodiment of FIG. 1C.

FIG. 3 is a side view of a lift arm 237 of the multi-axis vehicle door hinge 201 showing the lift arm comprising edge fastener bores for coupling with a lift rotation limiter 440 in accordance with the embodiment of FIG. 1C. The arm second end 286 defines an edge 282 having a semi-cylindrical shape having an axis substantially coaxial with the axis of the arm bore 288 and having a radius larger than a radius defined by the arm bore 288. The edge 282 comprises a plurality of spaced-apart edge fastener bores 479 arranged in a radial pattern substantially radial with the axis of the arm bore 288. A plurality of edge fastener bores 479 are adapted to align with corresponding limiter fastener bores as discussed below. The edge fastener bores 479 are threaded for receiving a threaded fastener, such as, but not limited to, a bolt. A lift rotation limiter 440 is adapted to couple with the edge 282 as discussed below.

Figure 4A:
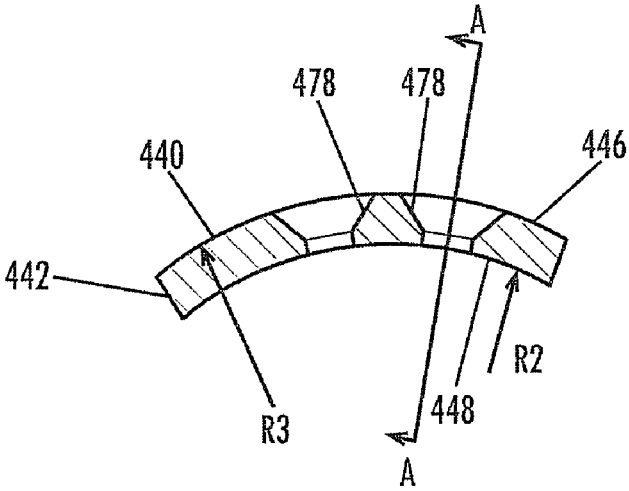
FIGS. 4A and 4B are side and cross-sectional views of a lift rotation limiter.
Figure 4B:
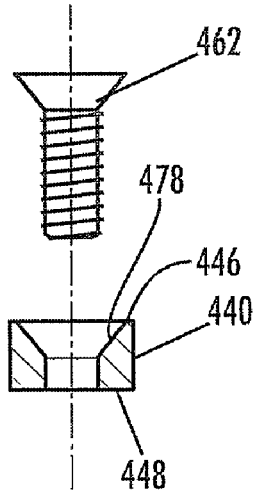

FIGS. 4A and 4B are side and cross-sectional views, respectively, of a lift rotation limiter 440, in accordance with an embodiment. The lift rotation limiter 440 comprises a partial cylindrical-shaped piece defining an arc having an inner radius R2 substantially the same as an outer radius R1 defined by the edge 282 of the arm second end 286, as shown in FIG. 3. The lift rotation limiter 440 defines an outer radius R3 and a thickness adapted to define an abutment end 442.

Referring again to FIG. 1C, the second leaf 220 further comprises a sag limiter rest 267 which partially defines the second leaf first edge 223 and extends from the second leaf first side 225 adjacent the second leaf first end 221. When coupled to the edge 282, the abutment end 442, shown in FIG. 4A, is adapted to abut the sag limiter rest 267 at a maximum lift angle .beta. of the lift arm 237.

Figure 5:
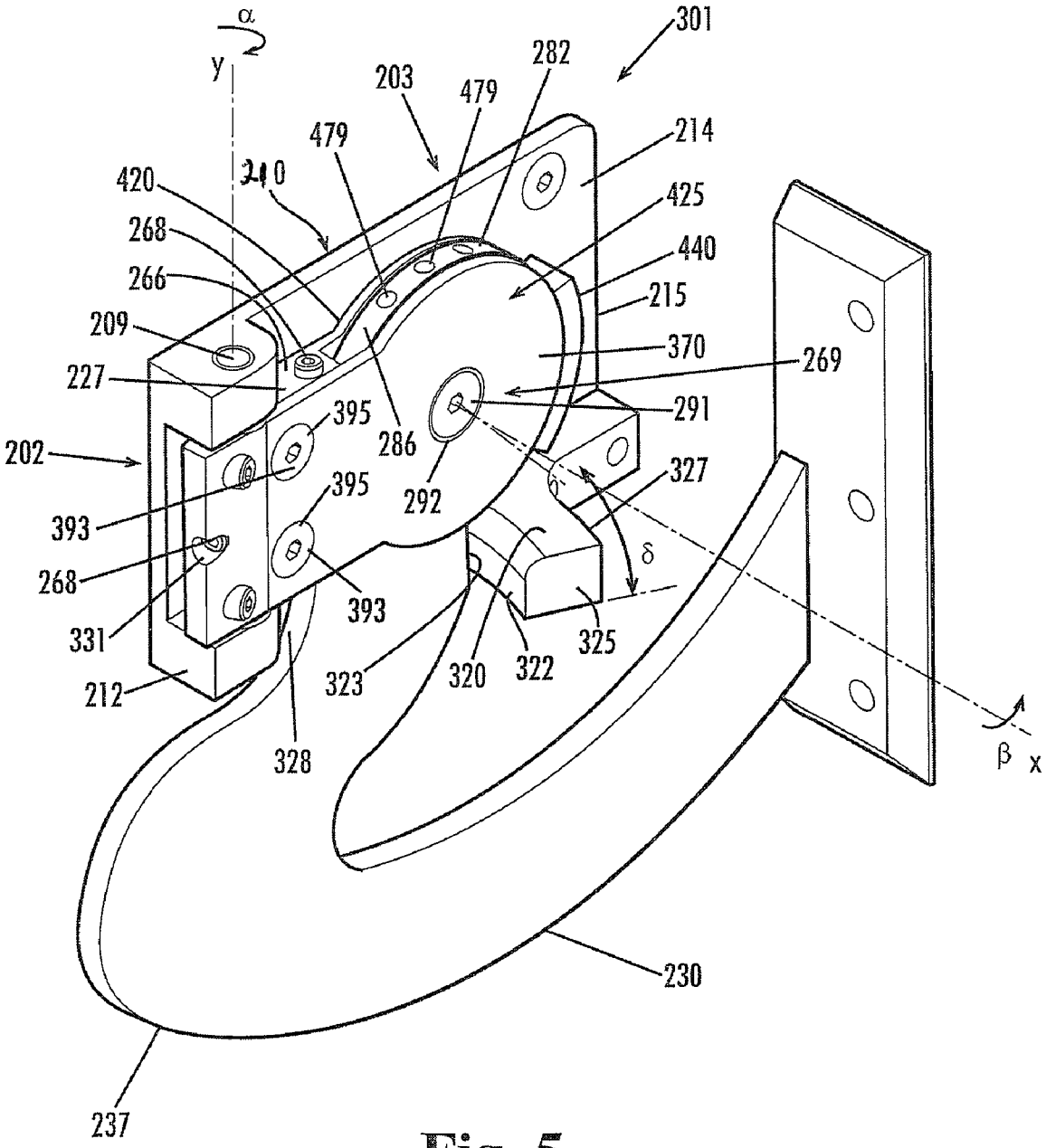
FIG. 5 is a side perspective view of a multi-axis vehicle door hinge, in accordance with an embodiment.

Referring again to FIGS. 4A and 4B, the lift rotation limiter 440 further comprises a plurality of limiter fastener bores 478 arranged in a radial pattern from the inner radius R2, the pattern in cooperative coaxial arrangement with corresponding edge fastener bores 479. Each limiter fastener bore 478 is adapted to slidingly receive a threaded fastener 462 extending from the outer surface 446 through the inner surface 448. The lift rotation limiter 440 is coupled to the edge 282, as shown in FIGS. 1C and 5, by one or more threaded fasteners 462 threadably engaged with the edge fastener bore 479, so as to couple the lift rotation limiter 440 to the edge 282 of the arm second end 286. A plurality of edge fastener bores 479 are provided to give the user a choice of location about the circumference of the edge 282 for placement of the lift rotation limiter 440, so as to change the maximum lift angle .beta. of the lift arm 237.

Referring again to FIGS. 1A-1C, the lift rotation limiter 440 limits the maximum extent of rotation, shown as .beta. in FIG. 1B, of the lift arm 237 relative to the second leaf 220 about the lift hub 274. The maximum extent of rotation of the lift arm 237 is selectable by positioning or repositioning the lift rotation limiter 440 adjacent predetermined edge fastener bores 479.

The length of the lift rotation limiter 440 further defines the range of motion and maximum extent of rotation, of the lift arm 237 about the lift hub 274.

Referring also to FIG. 2, it is appreciated that the available range of motion of the multi-axis vehicle door hinge 201 as coupled to a vehicle 50, minimum and maximum extent of rotation about the lift hub 274, and thus, the lift angle .beta., is limited only to the maximum extent in which the door 53 does not collide with the vehicle body 51. The available range of motion of the multi-axis vehicle door hinge 201 about the lift hub 274 itself is limited only to the collision of elements of the third leaf 230 with elements of the second leaf 220, which in the embodiment of FIG. 1B exceeds approximately 270 .degrees.

Referring again to FIGS. 1A and 1C, the multi-axis vehicle door hinge 201 further comprises a cap 270 suitable for coupling the arm second end 286 to the lift hub 274. The cap 270 retains the arm second end 286 to the lift hub 274 by engagement of a fastener 291 passing through a hub through hole 292 in the cap 270 to threadably engage the threaded bore 277 in the lift hub 274.

FIG. 5 is a side perspective view of a multi-axis vehicle door hinge 301, in accordance with an embodiment. The multi-axis vehicle door hinge 301, is substantially similar to the embodiment of FIGS. 1A-1C, comprises a first leaf 210, a second leaf 420, a third leaf 230, and a lift rotation limiter 440 coupled to the edge 282. The first leaf 210 and the second leaf 420 are coupled with a hinge pin 209 defining a swing-out hinge 202 that provides rotation in a substantially horizontal plane about a substantially vertical axis of rotation Y. The second leaf 420 and the third leaf 230 are coupled about a lift bearing 269 defining a vertical-lift hinge 203 that provides rotation in a substantially vertical plane about a substantially horizontal axis X of rotation. The multi-axis vehicle door hinge 301, therefore, provides rotation in a substantially horizontal plane, noted as swing angle .alpha., and rotation in a substantially vertical plane, noted as lift angle .beta., separately, and in combination, to suit a particular purpose.

Figure 6A:
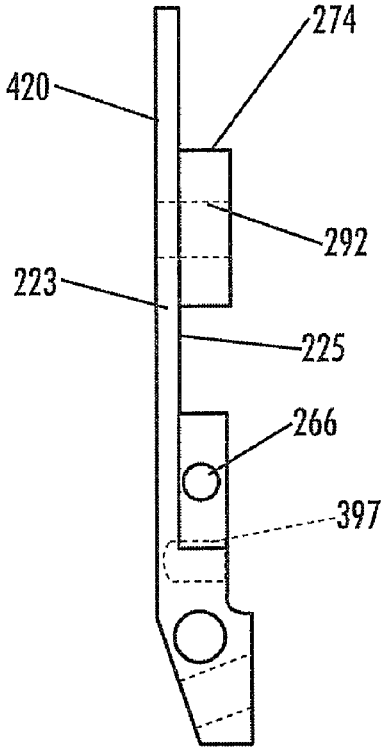
FIGS. 6A and 6B are side and front views of a second leaf of the multi-axis vehicle door hinge, in accordance with the embodiment of FIG. 5.
Figure 6B:
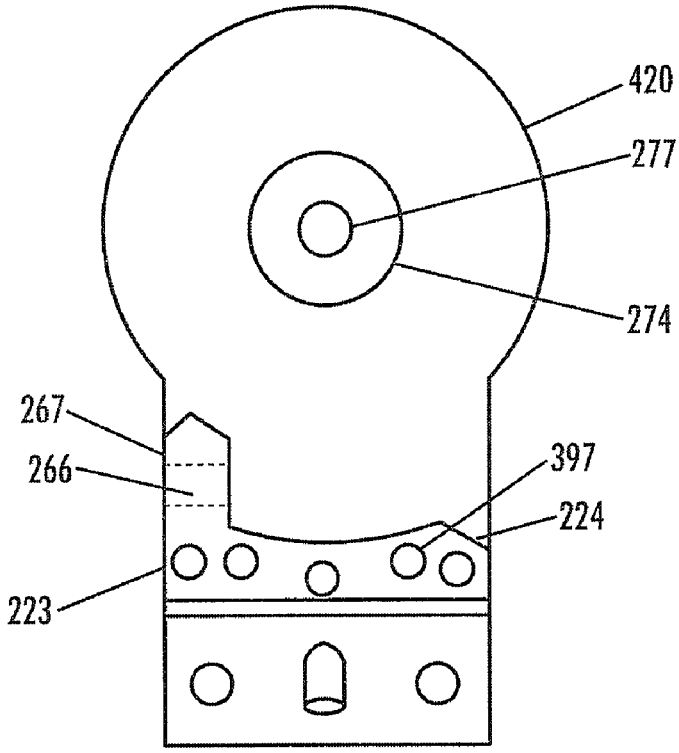

The multi-axis vehicle door hinge 301 further comprises a cap 370 suitable for coupling the arm second end 286 to the lift hub 274, substantially as shown in FIG. 1C. FIGS. 6A and 6B are side and front views of the second leaf 220 of the multi-axis vehicle door hinge in accordance with the embodiment of FIG. 5. The second leaf 420 comprises threaded fastener bores 397 that are complimentary with cap through holes 395 in the cap 370. The cap 370 retains the arm second end 286 to the lift hub 274 by engagement of a fastener 291, shown in FIG. 5, passing through a hub through hole 292 in the cap 370 to threadably engage the threaded bore 277 in the lift hub 274 of the second leaf 420, substantially similar to the cap 270 of FIG. 1C. The cap 370 is adapted to cover the arm second end 286 and a portion of the second leaf 420 adjacent the second swing knuckle 227. In this way, the cap 370 covers elements of the second leaf 420 and the third leaf 230 that come in close engagement that could pose a safety concern.

It is appreciated that there are a plurality of component modifications and changes suitable for a particular purpose. The previous and following specific embodiments highlight various elements that provide various control over the swing and lift of the multi-axis vehicle door hinge. Though these embodiments show elements in specific combinations, it is appreciated that these and other elements can be used singularly and in combination suitable for a particular purpose.

Referring again to FIGS. 1C and 5, the second leaf 220, 420 further comprises a sag limiter rest 267 which partially defines the second leaf first edge 223 and extends from the second leaf first side 225 adjacent the second leaf first edge 223. The sag limiter rest 267 comprises a threaded bore 266 extending from the second leaf first edge 223 towards the second leaf second edge 224. The threaded bore 266 is adapted to receive a suitable fastener 268, such as but not limited to, a bolt and set screw, so as a portion of the fastener 268 extends beyond the sag limiter rest 267 and towards the second leaf second edge 224.

Referring again to FIG. 1C, the lift arm 237 further comprises an engagement step 265 a predetermined location about the circumference of the arm second end 286. The engagement step 265 extends from the generally circular arm second end 286 a predetermined distance so as to engage the fastener 268 extending from the sag limiter rest 267 when the lift arm 237 is at a predetermined minimum lift angle .beta. to provide adjustability to the minimum lift angle .beta., as defined in FIG. 1B. The engagement and movement of fastener 268 about the threaded bore 266 allows for the adjustment of the fastener 268 to extend from the sag limiter rest 267 a predetermined distance so as to provide adjustability to the minimum lift angle .beta. of the lift arm 237, which is useful in adjusting the level of the door within the door frame of the vehicle. The adjustment of the fastener 268 is easily performed by the user after the multi-axis vehicle door hinge 201, 301 is installed in a vehicle.

Figure 7:
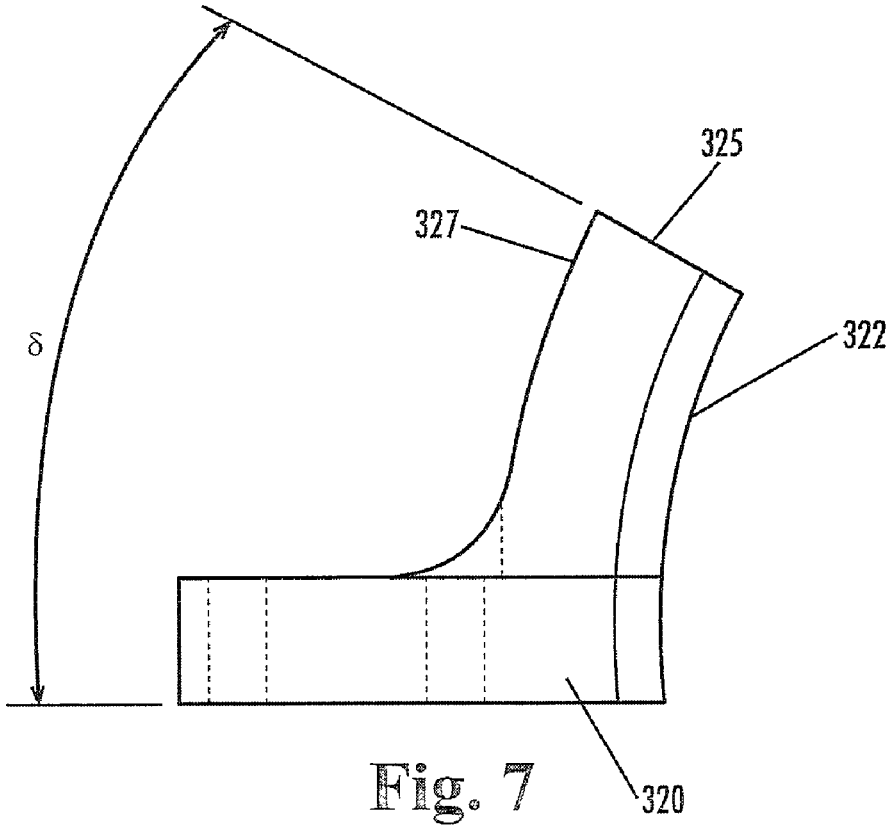
FIG. 7 is a top view of the lift hinge retention element, in accordance with an embodiment.

Referring again to FIG. 5, the multi-axis vehicle door hinge 301 further comprises a lift hinge retention element 320, in accordance with an embodiment. FIG. 7 is a top view of the lift hinge retention element 320. The lift hinge retention element 320 is adapted to restrict the vertical motion of the lift arm 237 until the swing-out hinge 202 has opened to a predetermined angle .delta.

The lift hinge retention element 320 is an integral or coupled element that extends a predetermined distance, defining angle .delta., from the first leaf second side 214 adjacent the first leaf second edge 212 and the first leaf third edge 215. The lift hinge retention element 320 comprises a first engagement surface 322 adjacent the lift arm 237 when the lift arm 237 is in the down position and the second leaf 220 is in the closed position. The first engagement surface 322 is adapted for cooperative engagement with a first lift arm engagement surface 323 to restrict the function of the vertical-lift feature of the multi-axis vehicle door hinge 301 until the swing angle of the second hinge leaf 420 exceeds angle .delta., and the lift arm 237 clears the lift hinge retention element 320.

The lift hinge retention element 320 terminates at a second engagement surface 325. Once the second hinge leaf 420 exceeds angle .delta., the lift arm 237 is not subject to engagement with the first engagement surface 322 and is free to rotate vertically about the lift hub. When the lift arm 237 is in the rotated position, the lift arm 237 is prevented from moving to a swing angle less than angle .delta. by the cooperative engagement of the lift arm 237 and the second engagement surface 325.

In operation, the door is opened initially from a closed position in the conventional swing-out rotation. At a predetermined swing-out angle .delta., or greater, of the door 53 to the vehicle body 51, as shown in FIG. 2, the lift arm 237 pivots clear of the lift hinge retention element 320, permitting a vertical rotation of the door 53 in an upward direction about the vertical-lift hinge 203, to a predetermined angle .beta. The door 53 is initially closed by vertically rotating the door 53 down from a lifted position. The lift hinge retention element 320 is adapted to prevent the downward rotation of the door 53 unless the door 53 is at, or greater than, the predetermined swing-out angle .delta. The door 53 is lowered to a substantially horizontal position where the lift arm 237 is clear of the second engagement surface 325 as the vertical-lift hinge 203 is fully closed or lowered. The door 53 is subsequently closed in the conventional swing-in manner.

In another embodiment, the lift hinge retention element 320 comprises a third engagement surface 327 opposite the first engagement surface 322. The lift arm 237 is adapted to rotate upward to an angle .beta. such that the lift arm 237 rotates beyond and clear of the first engagement surface 322 and the second engagement surface 325. The third engagement surface 327 is adapted for cooperative engagement with a lift arm surface, such as, but not limited to, lift arm surface 328, when the third hinge leaf 230 is moved to a position less than angle .delta. while the lift arm 237 is in the up position. While in the up position and at an angle of less than angle .delta., the lift arm 237 engages the third engagement surface 327 restricting downward rotation of the third leaf 230. Thus, the lift hinge retention element 320 is adapted to retain the third leaf 230 in an up position.

The length of the lift hinge retention element 320 extending from the first leaf second side 214, shown in FIG. 1C, determines, among other things, the minimum swing-out angle .delta. where the lift hinge retention element 320 disengages with the lift arm 237. A longer lift hinge retention element 320 will engage the lift arm 237 over a greater swing-out angle .delta. than would be provided by a shorter lift hinge retention element 320.

The multi-axis vehicle door hinge 301 requires an initial swing-out prior to enabling vertical-lift of the door 53, shown in FIG. 2, providing a number of advantages. These advantages include, but are not limited to, retaining the conventional swing-out operating characteristics associated with the initial opening and final closing movement of the door, and enabling the ability to accommodate many door shapes for vertical-lift operation. Retaining the initial swing-out of the door provides that no modification to the stock latching and closing mechanism is required. Further, the integrity of the stock door sealing and weather stripping system is not compromised.

The initial swing-out of the door 53 provides that all door structures will clear the vehicle body 51 as the door 53 is vertically-lifted, shown in FIG. 2. This permits the incorporation of vertical door operation for vehicles with doors that have structures that would collide with the vehicle body 51 if the door 53 were to be opened using a single-axis vertical-lift hinge. Such door structures include, but are not limited to, an undercut bottom door edge that wraps inwardly under the vehicle body 51 that would collide with the doorjamb 152.

In other embodiments, the multi-axis vehicle door hinge further comprises torsion control for the vertical lift hinge. Torsion control provides assistance in the operation of the lift arm by providing one or a combination of: return bias for returning the lift arm to the down position; retaining, counterbalancing or equilibrating the lift arm in any position between down and up when released by the user; and biasing the lift arm in the maximum up position. Embodiments of the multi-axis vehicle door hinge further comprise torsion control in the forms of springs, gas struts, and linear actuators, wherein the linear actuators can provide for powered operation.

It is appreciated that the multi-axis vehicle door hinge 201, 301, shown in FIGS. 1A and 5, will operate in substantially the same manner where the arrangement of the knuckles and notches are transposed on respective leaves. Referring again to FIGS. 1A-1C, the first swing knuckles 217 and the swing notch 296 of the first leaf 210 is replaced with a single swing knuckle, and the second swing knuckle 227 on the second leaf 220 is replaced with two swing knuckles and a swing notch. Also, it is appreciated that the number of knuckles and notches may vary without deviating from the basic operation and function of the multi-axis vehicle door hinge 201.

It is appreciated that the shape of the knuckles and notches may be varied while retaining the functionality provided by the multi-axis vehicle door hinge 201, 301. For example, but not limited thereto, the knuckle is in the form of one or more extending flanges each having an aperture substantially coaxial with the other, each flange aperture being coaxial with and placed in sliding pivoting engagement with a corresponding flange aperture of a corresponding leaf.

Referring again to FIG. 2, the multi-axis vehicle door hinge 201, 301 of FIGS. 1A and 5 is used to couple the door 53 to the vehicle body 51. The first leaf 210 is coupled to the hinge mount body surface 52 of a doorjamb 152 with the swing hinge 202 orientated away from the vehicle body 51 to function as a stationary leaf. The third leaf 230 is coupled to the hinge mount door surface 54 of the door edge 154 with the vertical-lift hinge 203 in an upward orientation to function as a hinge leaf. The second leaf 220 is coupled to the first leaf 210 and the third leaf 230 to allow for swing-out and vertical-lift movement, respectively, as previously described.

It is contemplated that a wide variety of locations may be used as the hinge mount body surface 52 and the hinge mount door surface 54 as being suitable for a particular purpose. For example, but not limited thereto, the hinge mount door surface 54 is a forward door inner surface. In another embodiment, providing pivoting motion from the rear of the door 53, the hinge mount body surface 52 is a rear portion of the doorjamb 152 and the hinge mount door surface 54 is a rear door edge, providing door opening from the front of the door 53 rather than from the rear.

In an application of the multi-axis vehicle door hinge 201, 301, in accordance embodiments, the first leaf 210 is the stationary leaf coupled to a hinge mount body surface 52 of a doorjamb 152 of a vehicle 50 as shown in FIG. 2. The hinge mount body surface 52 may take many forms that are particular to specific models of vehicle 50, and therefore, the first leaf 210 is adapted to facilitate coupling to a specific hinge mount body surface 52 particular to the vehicle 50. The first leaf first side 213 is coupled to the hinge mount body surface 52 using any number of appropriate coupling means known in the art, including, but not limited to, welding, brazing, and mechanical fastening.

In an embodiment, the first leaf 210 is adapted to facilitate the provision of a plurality of bolt holes 37 extending from the first leaf first side 213 to the first leaf second side 214, such as, but not limited to, those made by the consumer or assembler using a drill. The plurality of bolt holes 37 are located in predetermined locations that correspond to a bolt pattern provided in the hinge mount body surface 52 of the doorjamb 152 of a specific vehicle 50 after the removal of the conventional stock hinge. In another embodiment, the plurality of bolt holes 37 correspond to a new bolt hole pattern provided in the hinge mount body surface 52 of the doorjamb 152 made by the consumer or assembler. One or more bolts (not shown) couple the first leaf 210 to the vehicle 50.

In another embodiment, the first leaf 210 is provided with a plurality of bolt holes 37 in predetermined locations that correspond to a bolt pattern provided in a hinge mount body surface 52 of the doorjamb 152 of one or more specific model of vehicle 50 after the removal of the conventional stock hinge, negating the need for the consumer or assembler to provide the bolt hole pattern in the multi-axis vehicle door hinge 201, 301.

In yet another embodiment, the first leaf 210 is provided with a plurality of elongated bolt holes (not shown) in predetermined locations that correspond to one or more bolt patterns provided in the hinge mount body surface 52 of the doorjamb 152 of one or more specific models of vehicle 50 after the removal of the conventional stock hinge. The elongated bolt holes allow for, among other things, accommodation of mal-aligned bolt hole patterns and applicability across a plurality of models of vehicle.

The specific configuration of the first leaf 210 to permit coupling to a vehicle surface is dependent on a specific vehicle under consideration. Therefore, it is understood that other leaf configurations are anticipated that are adapted to couple to a vehicle's particular body and/or door surface while retaining the mechanical function of a component of a multi-axis vehicle door hinge, as provided herein.

As stated previously, the specific configuration of a first leaf 210 and/or a third leaf 230 to permit coupling to a hinge mount body surface 52 and/or hinge mount door surface 54, respectively, is dependent on the specific vehicle under consideration. Therefore, it is understood that other leaf configurations are anticipated that are adapted to couple to a vehicle's particular body and/or door surface while retaining the mechanical function of the multi-axis vehicle door hinge 201, 301 as provided herein.

Another important consideration, among others, in the retrofitting of conventional swing-out doors with swing-out vertical-lift operation is to provide the ability to adjust or fine tune the operation and alignment of the multi-axis vehicle door hinge. Adjustment and alignment considerations can take many forms, including, but not limited to: strategic placement of the multi-axis vehicle door hinge for proper alt-azimuth location of the vertical and horizontal pivot axis location; means for accommodating misaligned bolt holes; means for adjusting minimum swing-out opening angle α until disengagement of the lift arm 237 and the lift hinge retention element 320; adjustment means for adjusting maximum swing-out opening angle α, and adjustment means for adjusting door alignment with the doorjamb.

In an embodiment, means for accommodating misaligned bolt holes between the bolt holes of the first leaf 210 and the hinge mount body surface 52, and the bolt holes 37 of the third leaf 30 and the hinge mount door surface 54, is provided. As discussed previously, in one embodiment, the bolt holes 37 in the first leaf 210 and/or the third leaf 230 are elongated to facilitate alignment with misaligned bolt holes 37 in the hinge mount body surface 52 and/or hinge mount door surface 54. In another embodiment, the elongated bolt holes 37 further provide the ability to adjust and align the angular position of the multi-axis vehicle door hinge with respect to global horizontal and vertical axes.

Embodiments of a vertical-lift door system provides the assembler or consumer an integrated system of one or more hinges and lift assist devices to provide the operating characteristics of a swing-out vertical-lift door. The lift assist devices provide for, singularly or in combination, among other things, controlled and deliberate movement of the door, power-assisted door operation, and easier integration and assembly onto vehicles during assembly as well as stock vehicles for retrofit applications.

Embodiments of the multi-axis vehicle door hinge provide the ability to make available vertical-lift door operation not only to vehicle manufacturers, but also to the vehicle enthusiast who desires to convert a vehicle from swing-out door operation to vertical-lift operation with a minimum amount of modification to the vehicle.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A multi-axis vehicle door hinge, comprising:

a first leaf;

a second leaf;

a third leaf, the first leaf and the second leaf pivotally coupled defining a swing-out hinge adapted so as to enable rotation in a substantially horizontal plane about a substantially vertical axis of rotation, the second leaf and the third leaf pivotally coupled about a lift bearing defining a vertical-lift hinge adapted so as to enable rotation in a substantially vertical plane about a substantially horizontal axis of rotation;

a lift rotation limiter removably coupled to the third leaf and adapted to provide adjustment means for setting a predetermining maximum extent of the vertical-lift hinge; and a hinge pin, the first leaf comprising:

a first leaf first edge;

a first leaf second edge opposite the first leaf first edge;

a first leaf first side;

a first leaf second side opposite the first leaf first side;

a first leaf third edge;

and a first leaf fourth edge opposite the first leaf third edge; and two spaced apart first swing knuckles extending from the first leaf second side adjacent the first leaf fourth edge defining a swing notch there between, the first swing knuckles each define a first swing knuckle bore there through, the axis of the first swing knuckle bores are in substantially coaxial alignment and define a substantially vertical axis;

the second leaf comprises:

a second leaf first end;

a second leaf second end opposite the second leaf first end;

a second leaf first edge;

a second leaf second edge opposite the second leaf first edge;

a second leaf first side;

a second leaf second side opposite the second leaf first side, the second leaf second end comprising a second swing knuckle bore extending between the second leaf first edge and the second leaf second edge defining a second swing knuckle, the second swing knuckle is adapted to be received within the swing notch of the first leaf with the axis of the first swing knuckle bores and second swing knuckle bore in substantially coaxial alignment, the hinge pin adapted to be received within the first swing knuckle bores and the second swing knuckle bore pivotally coupling the second leaf to the first leaf; and a lift hub defining a cylindrical shape extending substantially perpendicular from the second leaf first side adjacent the second leaf first end and defining an axis substantially perpendicular to the second swing knuckle bore, the lift hub defining a first half of a lift bearing;

the third leaf comprising:

a third leaf first end;

a third leaf second end opposite the third leaf first end;

a third leaf first side;

a third leaf second side opposite the third leaf first side;

a third leaf first edge;

a third leaf second edge opposite the third leaf first edge, the third leaf first and second end, the third leaf first and second side, and the third leaf first and second edge defining a mount plate, the mount plate adapted for coupling to a hinge mount door surface of a door; and a lift arm extending from the third leaf second side adjacent the third leaf second end, the lift arm comprising an arm first end coupled with the third leaf second side and an arm second end opposite the arm first end, the lift arm comprising an arm first side and an arm second side opposite the arm first side, the arm second end comprising an arm bore extending from the arm first side to the arm second side and having an axis extending substantially perpendicular to the arm first side, the arm bore adapted to receive the lift hub therein in substantially coaxial alignment therewith, the arm bore defining a second half of the lift bearing, the arm second end defining a semi-cylindrical edge having an axis substantially coaxial with the axis of the arm bore and having a radius larger than a radius defined by the arm bore, the edge including a plurality of spaced-apart edge fastener bores arranged in a radial pattern substantially radial with an axis of the arm bore, the edge fastener bores are threaded for receiving a threaded fastener, the lift rotation limiter comprising a partial cylindrical-shaped piece defining an arc having an inner radius substantially the same as an outer radius defined by the edge of the arm second end, the lift rotation limiter having an outer radius and a thickness adapted to define an abutment end, the lift rotation limiter further comprises a plurality of limiter fastener bores arranged in a radial pattern from the inner radius, the plurality of limiter fastener bores adapted for cooperative coaxial alignment with corresponding edge fastener bores, each limiter fastener bore is adapted to slidingly receive a threaded fastener extending through the thickness of the lift rotation limiter, the lift rotation limiter removably coupled to the edge by one or more fasteners threadably engaged with the edge fastener bore, so as to couple the lift rotation limiter to the edge of the arm second end, the plurality of edge fastener bores provided to allow adjustable placement of the lift rotation limiter about the circumference of the edge so as to change the maximum lift of the lift arm, the second leaf further comprising a sag limiter rest which partially defines the second leaf first edge and extends from the second leaf first side adjacent the second leaf first end, the abutment end of the lift rotation limiter adapted to abut the sag limiter rest at a maximum lift angle of the lift arm.

2. The hinge of claim 1, the lift arm comprising a generally goose-neck shape adapted to provide an extension of an attached door so as to clear structures of a vehicle when the hinge is operated.

3. The hinge of claim 2, further comprising a cap and a fastener, the cap having a through hole there through, the lift hub further comprising a threaded bore to receive the fastener therein, the cap adapted for coupling the arm second end to the lift hub by engagement of the fastener passing through the through hole to threadably engage the threaded bore in the lift hub.

4. The hinge of claim 2, the first leaf further comprising a recessed portion extending a predetermined distance into the first leaf second side, the recessed portion adapted to receive a portion of the second leaf first end therein.

5. The hinge of claim 2, the first leaf further a through hole extending from the first leaf second side to the first leaf first side, the through hole adapted to receive a portion of the second leaf first end therein.

6. The hinge of claim 2, the second leaf second end comprising a bevel portion defined therein, the bevel portion substantially facing the first leaf and adapted to prevent rotation of the second leaf greater than a predefined bevel angle by the impingement of the bevel portion with a bevel impact surface on the first leaf second side adjacent the first leaf fourth edge.

7. The hinge of claim 6, the second leaf second end defining one or more threaded swing-limiting bores extending through to the bevel portion and having axes extending substantially perpendicular with the bevel portion, end portions of suitable fasteners adapted to be received by the threaded swing-limiting bores and extend beyond the bevel portion to contact the bevel impact surface when the second leaf is at a predetermined swing angle to provide adjustability to the maximum swing angle.

8. The hinge of claim 1, wherein the sag limiter rest comprises a threaded bore extending from the second leaf first edge towards the second leaf second edge, the threaded bore adapted to receive a suitable fastener so as a portion of the fastener extends beyond the sag limiter rest and towards the second leaf second edge, the third leaf further comprising an engagement step a predetermined location adjacent the arm second end, the engagement step extends from adjacent the arm second end a predetermined distance so as to engage the fastener extending from the sag limiter rest when the third leaf is at a predetermined minimum lift angle to provide adjustability to the minimum lift angle, the engagement and movement of fastener about the threaded bore adapted for the adjustment of the fastener to extend from the sag limiter rest a predetermined distance so as to provide adjustability to the minimum lift angle of the third leaf, suitable for adjusting a level of a door within a door frame of a vehicle.

9. The hinge of claim 1, further comprising a lift hinge retention element adapted to restrict the vertical motion of the vertical-lift hinge until the swing-out hinge has opened equal to or greater than a predetermined angle .delta., the lift hinge retention element extending a predetermined distance from the first leaf second side adjacent the first leaf second edge and the first leaf third edge defining angle .delta., the lift hinge retention element comprising a first engagement surface adjacent the lift arm when the lift arm is in a down position, the first engagement surface adapted for cooperative engagement with a first lift arm engagement surface to restrict the function of the vertical-lift hinge until the swing angle of the second hinge leaf exceeds the predetermined angle .delta., the lift hinge retention element terminating at a second engagement surface adapted for cooperative engagement with the lift arm when the swing angle of the second leaf is at the predetermined angle .delta. and the lift arm is rotated greater than a minimum lift angle .beta., so as to restrict the function of the swing hinge when the lift arm is pivoted greater than the minimum lift angle .beta.

10. The hinge of claim 9, the lift hinge retention element further comprising a third engagement surface opposite the first engagement surface, the third engagement surface adapted such that when the lift arm is rotated a predetermined angle .beta. or more and the second leaf is pivoted a predetermined angle .delta. or less, the lift arm and the third engagement surface are adapted for cooperative engagement to restrict the third leaf from rotating down to less than the predetermined angle .beta.

11. A multi-axis vehicle door hinge, comprising:

a first leaf;

a second leaf;

a third leaf, the first leaf and the second leaf pivotally coupled defining a swing-out hinge adapted so as to enable rotation in a substantially horizontal plane about a substantially vertical axis of rotation, the second leaf and the third leaf pivotally coupled about a lift bearing defining a vertical-lift hinge adapted so as to enable rotation in a substantially vertical plane about a substantially horizontal axis of rotation; and a lift rotation limiter removably coupled to the third leaf and adapted to provide adjustment means for setting a predetermining maximum extent of the vertical-lift hinge, the second leaf further comprising:

a second leaf first end;

a second leaf second end opposite the second leaf first end; and a sag limiter rest comprising a threaded bore and a fastener, the threaded bore extending from adjacent the second leaf second end in a direction towards the second leaf first end, the threaded bore adapted to receive the fastener therein, the fastener being threadably engaged with at least a portion of the threaded bore and extending a predetermined distance beyond the threaded bore in a direction towards the second leaf first end so as to engage the third leaf when the third leaf is at a predetermined minimum lift angle operable to limit the rotation of the third leaf to the predetermined minimum lift angle.

12. A multi-axis vehicle door hinge, comprising:

a first leaf;

a second leaf;

a third leaf, the first leaf and the second leaf pivotally coupled defining a swing-out hinge adapted so as to enable rotation in a substantially horizontal plane about a substantially vertical axis of rotation, the second leaf and the third leaf pivotally coupled about a lift bearing defining a vertical-lift hinge adapted so as to enable rotation in a substantially vertical plane about a substantially horizontal axis of rotation;

a lift rotation limiter removably coupled to the third leaf and adapted to provide adjustment means for setting a predetermining maximum extent of the vertical-lift hinge; and a lift hinge retention element extending from the first leaf defining a predetermined angle .delta., the lift hinge retention element adapted to restrict the vertical motion of the vertical-lift hinge until the swing-out hinge has opened equal to or greater than angle .delta., the lift hinge retention element comprising a first engagement surface adjacent the lift arm when the lift arm is in a down position, the first engagement surface adapted for cooperative engagement with the lift arm to restrict the function of the vertical-lift hinge until the swing angle of the second hinge leaf exceeds the predetermined angle .delta., the lift hinge retention element terminating at a second engagement surface adapted for cooperative engagement with the lift arm when the swing angle of the second leaf is at the predetermined angle .delta. and the lift arm is rotated greater than a minimum lift angle .beta., so as to restrict the function of the swing hinge when the lift arm is pivoted greater than the minimum lift angle .beta.

13. The hinge of claim 12, the lift hinge retention element further comprising a third engagement surface opposite the first engagement surface, the third engagement surface adapted such that when the lift arm is rotated a predetermined angle .beta. or more and the second leaf is pivoted a predetermined angle .delta. or less, the lift arm and the third engagement surface are adapted for cooperative engagement to restrict the third leaf from rotating down to less than the predetermined angle .beta..

* * * * *